US005079887A

United States Patent [19]

Anderson

[11] Patent Number: 5,079,887

[45] Date of Patent: Jan. 14, 1992

[54] SUSPENDED RIGID CEILING VOLUME REDUCTION SYSTEM

[75] Inventor: Richard F. Anderson, Houston, Tex.

[73] Assignee: Conservatek Industries, Inc., Conroe, Tex.

[21] Appl. No.: 591,395

[22] Filed: Oct. 1, 1990

[51] Int. Cl.[5] ..... E04B 9/18

[52] U.S. Cl. ..... 52/488; 52/81; 52/22

[58] Field of Search ..... 52/18, 22, 484, 488, 52/80, 396; 210/187

[56] References Cited

U.S. PATENT DOCUMENTS

| | | | |
|---|---|---|---|
| 2,182,852 | 12/1939 | Mulford | 52/22 |
| 3,049,070 | 8/1962 | Hawk | 52/81 |
| 4,663,894 | 5/1987 | LaRoche et al. | 52/396 |

*Primary Examiner*—Richard E. Chilcot, Jr.
*Assistant Examiner*—Wynn Wood
*Attorney, Agent, or Firm*—Kirk & Lindsay

[57] ABSTRACT

The invention is directed to a ceiling which is supported within a closure structure such as a dome. The edge of the ceiling is sealed to the closure structure by a non-permeable flexible fabric. Both the ceiling and the edge seal are airtight to prevent the passage of gases from a region below the ceiling within the closure structure to a region above the ceiling within the closure structure.

17 Claims, 4 Drawing Sheets

SUSPENDED RIGID CEILING VOLUME REDUCTION SYSTEM

BACKGROUND OF THE INVENTION

The present invention generally relates to a rigid ceiling supported within a closure structure and, more particularly, is concerned with a rigid ceiling suspended from and sealed within a closure structure for reducing the volume over a vessel.

A variety of gases are released from vessels containing pools of waste, petroleum and other stored liquids and semi-solids. Over time the content of these gases will increase within the internal volume of a closure structure above the surface of the pool. This volume of gases (such as $H_2S$ or methane) must periodically be cleaned to reduce odors or so that regulated gas contents do not exceed certain prescribed standards. It is therefore desirable that the volume within the closure structure over the pool of waste be kept as small as possible to minimize the volume of gases which must be periodically cleansed and therefore save on cleaning costs.

One type of closure structure which can be used is internally supported. However, it is not desirable to build a closure structure which will require columns or other types of supports which run vertically up from the pool of waste to support the roof of the closure structure. First of all, the pool of waste may require agitation and the pool is easier to agitate when there is no interference from supporting structures. Secondly, supporting structures in contact with the pool create a location which encourages the buildup of waste within the pool. For these reasons it is desirable to build a self-supporting closure structure over the pool of waste.

Domes and vaults are closure structures which can be constructed to be self-supporting over large areas. However, the structure of vaults and domes creates a larger volume within the closure structure than is created by internally supported closure structures.

Prior practices have described ceilings installed within a dome or self-supporting structure. Apparatus has also been described for placing a floating deck within a vessel to prevent vapor losses.

U.S. Pat. No. 1,825,800 to Houseman discloses a frame capable of supporting the weight of a ceiling and a roof covering without the use of intermediate vertical supporting posts. A false ceiling may be suspended from the roof. The ceiling is designed to insulate the inside area of the enclosure from overhead noises.

U.S. Pat. No. 2,341,548 to Heineman describes a diaphragm which extends across the top of a container below and spaced from a roof. An upper compartment is completely sealed such that the placement of a liquid in the upper compartment will decrease the temperature variations of the contents of the lower compartment due to absorption of the heat of vaporization during temperature rises and due to the return of this heat, by condensation, as the temperature drops.

U.S. Pat. No. 3,279,606 to Cox discloses a gas dome for anaerobic digesters including a rain shed and a ceiling plate. Trusses extend between the rain shed and ceiling plate. A gas deflector skirt or rim plate may be used to prevent the escape of any gas between the cover and the tank wall. The cover is dome shaped so that sludge gas generated during the digestion of the sludge is directed toward the central gas dome.

The publication entitled "Geodesic-Dome Tank Roof Cuts Water Contamination, Vapor Losses" from the *Oil and Gas Journal* describes the use of a floating deck within a tank. The floating deck is sealed around the rim to prevent vapor emissions.

None of the prior art patents are designed to fulfill the needs met by the present invention. These inventions are not designed to maintain an airtight seal within a closure structure over and above a deposit of waste. The patent to Houseman is relevant only in that it discloses a ceiling suspended from a roof. The patent to Heineman does not disclose the manner in which the diaphragm will specifically be constructed and how such diaphragm will achieve a seal. Heineman also fails to disclose a manner for maintaining a seal during conditions of distortion of the container. The patent to Cox does not disclose apparatus for suspending a ceiling from the closure structure, the structure of a lightweight ceiling which provides an effective seal and a manner of maintaining a seal around the edge of the ceiling while allowing for motion of the ceiling relative to adjacent structures.

The floating cover art has several disadvantages. Since floating covers are constructed to move independent of the vessel, they are not gas tight around the periphery of the cover. Floating covers also have a short useful service life, require periodic cleaning and act as catch basins for airborne debris and trash. Floating covers also obstruct equipment designed to interact with the substance contained in the vessel.

SUMMARY OF THE INVENTION

Consequently, a need exists for a structure which will reduce the volume over a vessel containing a substance which by regulation requires air changes. Moreover, it is preferred that such a structure be adaptable for use in self supporting closure structures such as domes and vaults. The structure must achieve an effective seal within a closure structure while being lightweight and adaptable to distortions of the closure structure. The structure must also be supportable within a closure structure and such support must be achieved without obstruction of the contents of the vessel or equipment used to agitate the contents of the vessel.

As used herein the term closure structure is synonymous with roof. The terms dome and vault are closure structure species, however closure structures are not limited to these two species. The term vessel can refer to water storage reservoirs, petroleum storage tanks and tanks used to treat pools of waste as well as other types of tanks. Closure structures can range in size from approximately fifteen to hundreds of feet in diameter. Domes are preferably used as closure structures for round vessels, whereas vaults are preferably used as closure structures adapted to vessels of other shape. The present invention can be used in conjunction with new vessels or can be implemented with existing vessels and closure structures.

The invention is directed to a ceiling which is supported within a closure structure such as a dome. The edge of the ceiling is sealed to the closure structure by a non-permeable flexible fabric. Both the ceiling and the edge seal are airtight to prevent the passage of gases from a region below the ceiling within the closure structure to a region above the ceiling within the closure structure.

DETAILED DESCRIPTION OF THE INVENTION

Figure 1:
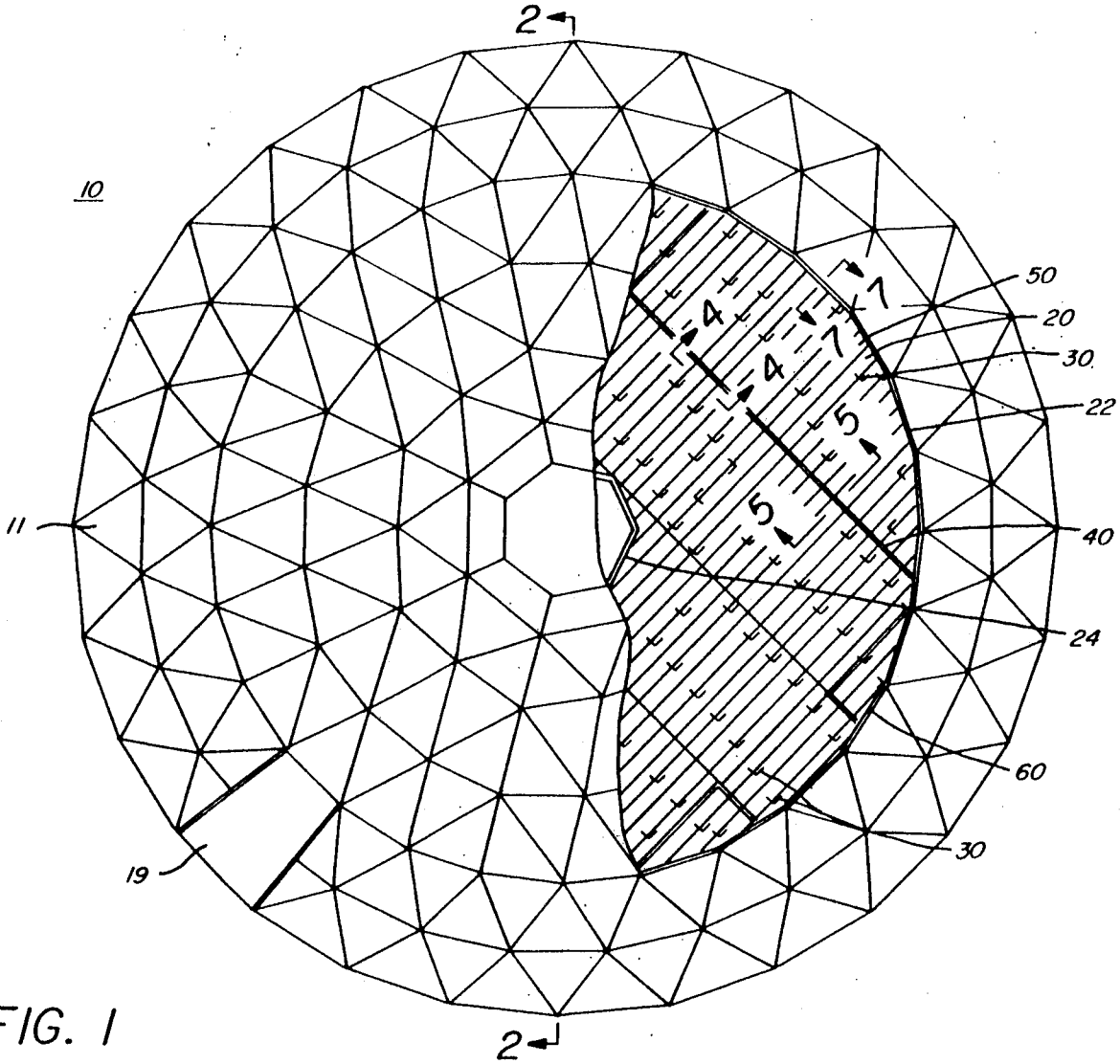
FIG. 1 is a top view of a dome shaped closure structure with a portion cut away to show the invention described herein.

Referring now to FIG. 1 of the drawings, a typical closure structure 10 which may be placed over a deposit of waste or vessel is represented. A portion of the view of the closure structure 10 has been cut away to reveal the volume reduction invention described below.

The volume reduction invention generally comprises ceiling 20, hangers 30 and flexible seal 60. Ceiling 20 is generally constructed from T-beams 40, C-beams 42 (FIGS. 3 and 4) and sheeting 50. The periphery or edge 22 of ceiling 20 is connected and sealed to closure structure 10 with the flexible seal 60.

Figure 2:
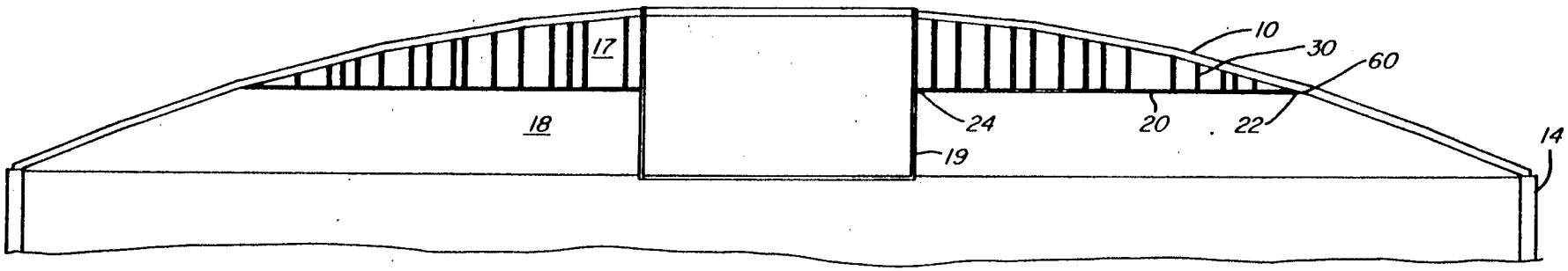
FIG. 2 is a cross-sectional view taken along line 2—2 of FIG. 1.

Referring now to FIG. 2, ceiling 20 is suspended from closure structure 10 over the composition within the vessel 14 to provide a barrier between upper region 17 and lower region 18. More specifically, ceiling 20 is suspended from hangers 30. The hangers 30 are constructed of various lengths so that ceiling 20 will be suspended in a horizontal position. A walkway 19 (FIG. 1) allows access to the interior of the closure structure 10. A center mechanism (not shown) may be included to agitate the composition within the vessel 14.

Figure 3:
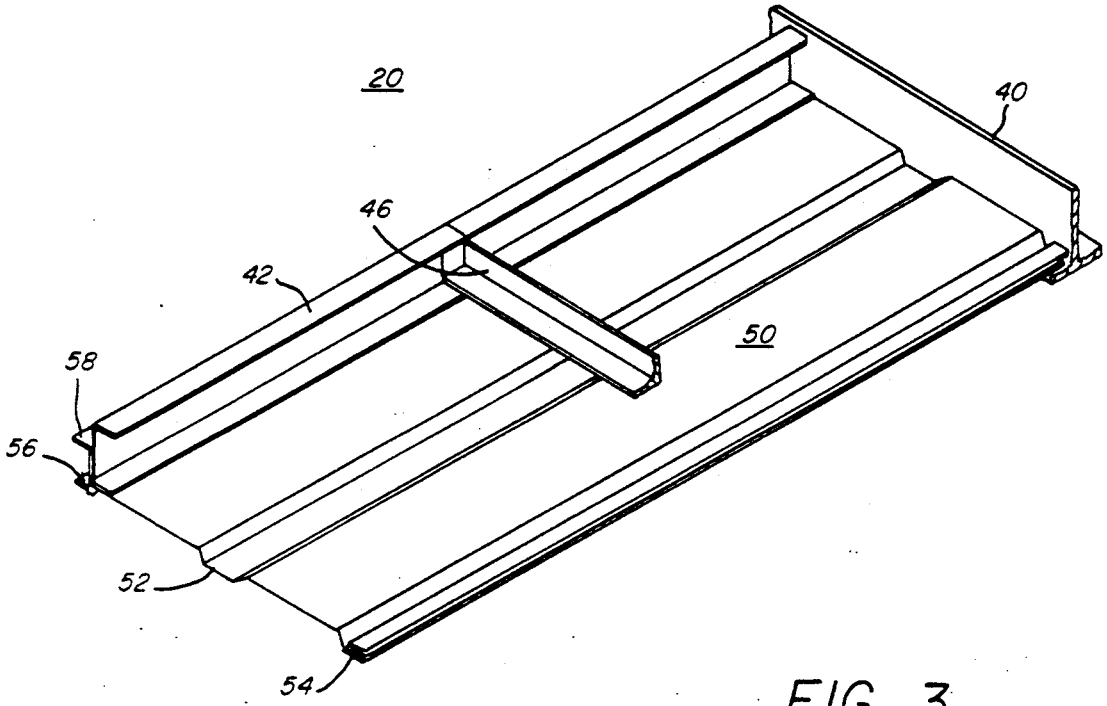
FIG. 3 is a perspective view showing details of the suspended ceiling.

A detail view of a portion of rigid ceiling 20 is shown in FIG. 3. The rigid ceiling 20 generally includes T-beams 40 and C-beams 42, which form the framework of the rigid ceiling 20, and sheeting 50 which is attached to the framework. Sheeting 50 includes corrugations 52, female terminating surface 54, male terminating surface 56 and formed-L 58. The ends of sheeting 50 which do not include female and male terminating surfaces 54 and 56 are attached to T-beam 40. A gasket and/or sealant (not shown) can be applied between the sheeting 50 and T-beam 40 for sealing purposes. The gaskets can be added between consecutive corrugations 52. A gasket with formed corrugations to mate with sheeting 50 corrugations 52 can also be used. C-beam 42 is attached on top of sheeting 50 and abutts formed-L 58.

Corrugations 52 and C-beams 42 help to stiffen sheeting 50 in one direction which helps to increase the effectiveness and longevity of the seal provided by the rigid ceiling 20. Stiffener pieces 46 are preferably attached on top of sheeting 50 and run perpendicular to corrugations 52 in order to stiffen sheeting 50 in the transverse direction. This also increases the longevity and effectiveness of the seal of the rigid ceiling 20. Stiffener pieces 46 are preferably made from pieces of angle although other lightweight rigid pieces may be used.

Figure 4:
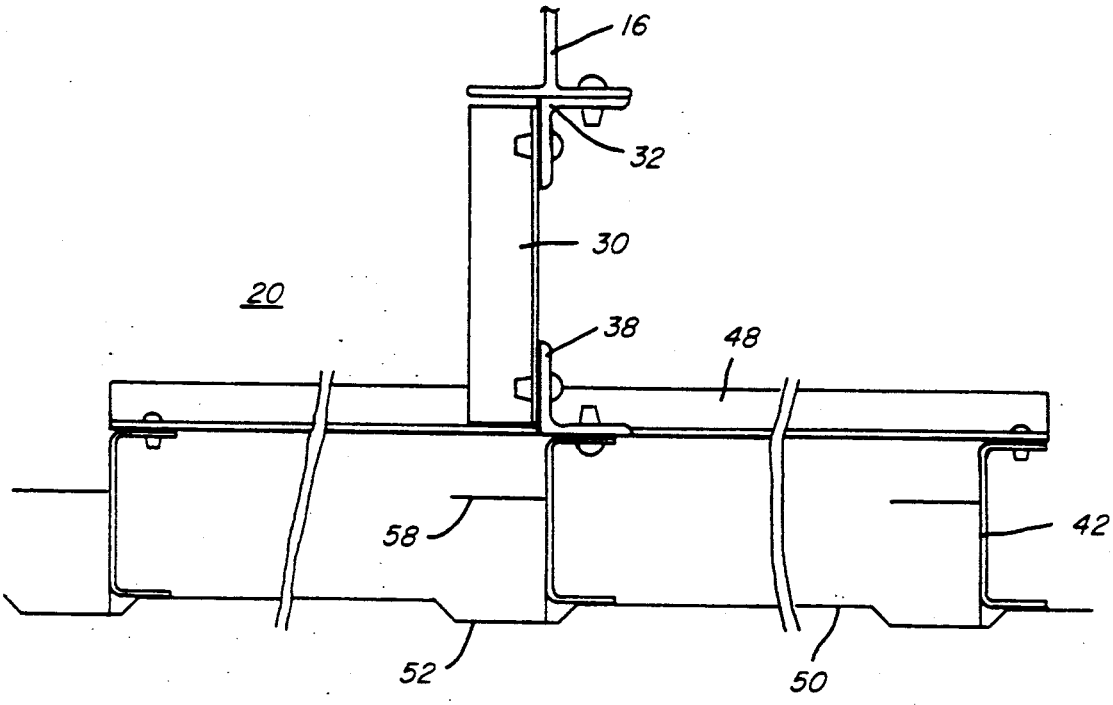
FIG. 4 is a cross-sectional view taken along line 4—4 of FIG. 1 showing details of the suspended ceiling.

FIG. 4 shows in detail the connection from the roof or dome 10 through a hanger 30 to the rigid ceiling 20. Strut 16 is par of the dome structure 10. Hanger 30 is connected to strut 16. This connection is preferably a hinged connection and as shown is preferably made through an angle 32 which is fastened to both the strut 16 and the hanger 30. The lower end of the hanger 30 is connected to the rigid ceiling 20. This connection is preferably a hinged connection as well and as shown is made through an angle 38 which is fastened to hanger 30 and to the rigid ceiling 20. Hinged connections are preferred at both ends of hanger 30 to allow for pivoting, play or motion in these connections. This helps to reduce forces transferred to the rigid ceiling 20 due to the force of gravity during load conditions placed upon the dome 10 or during conditions of thermal expansion or contraction.

Hangers 30 should be connected to the framework and not sheeting 50 of rigid ceiling 20 to prevent distortion and deterioration of the seal provided by rigid ceiling 20. Since the upper end of hangers 30 are attached to struts 16 the type of connection to be made at the lower end of hanger 30 will depend upon the structure of the rigid ceiling 20 directly under the hanger 30. Hangers 30 can be attached directly to T-beams 40 or C-beams 42. When a bridge to either T-beams 40, C-beams 42 or both is needed hangers are attached to bridging beams 48.

Figure 5:
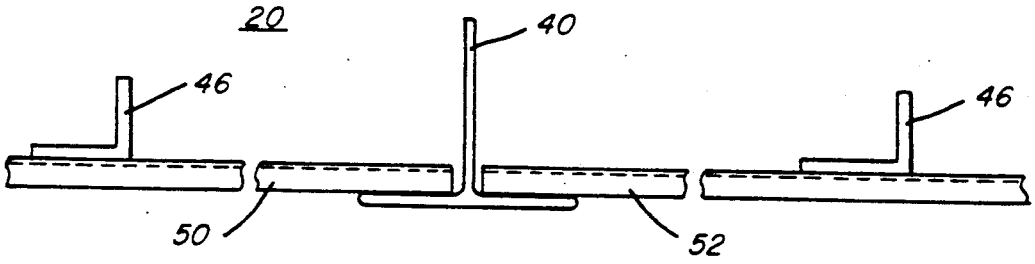
FIG. 5 is a cross-sectional view taken along line 5—5 of FIG. 1 showing details of the suspended ceiling.

As shown in FIG. 5, pieces of sheeting 50 are attached on each side of T-beam 40. Stiffener pieces 46 are attached on top of sheeting 50. Fasteners (not shown) are preferably used for making attachments.

Figure 6:
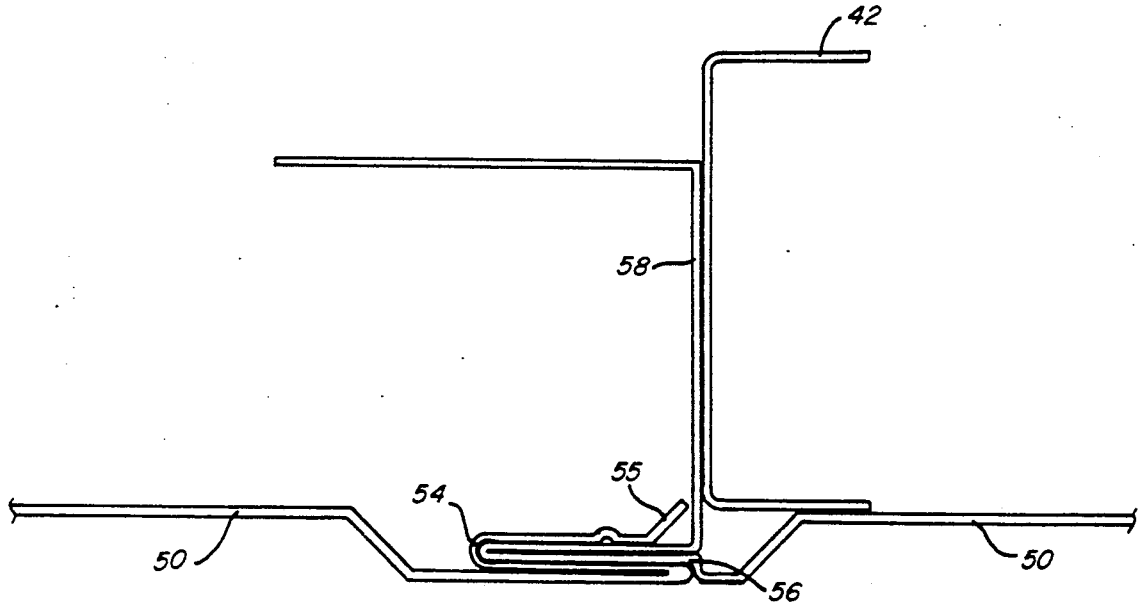
FIG. 6 is an enlarged view of the connection joint between two pieces of sheeting.

FIG. 6 shows a detail view of the connection joint between two adjoining pieces of sheeting 50. Male terminating surface 56 is inserted into female terminating surface 54 to make the connection. If desired, although not necessary, a sealant may be added to this joint to improve the effectiveness of the seal. Female terminating surface 54 preferably includes leg 55 to ease connection of female terminating surface 54 to male terminating surface 56. Formed-L 58 extends from male terminating surface 56 and serves as a support and connection surface for C-beam 42. Sheeting 50 can be constructed without formed-L 58 and/or leg 55 to be used at connection joints where no C-beam is to be attached.

Figure 7:
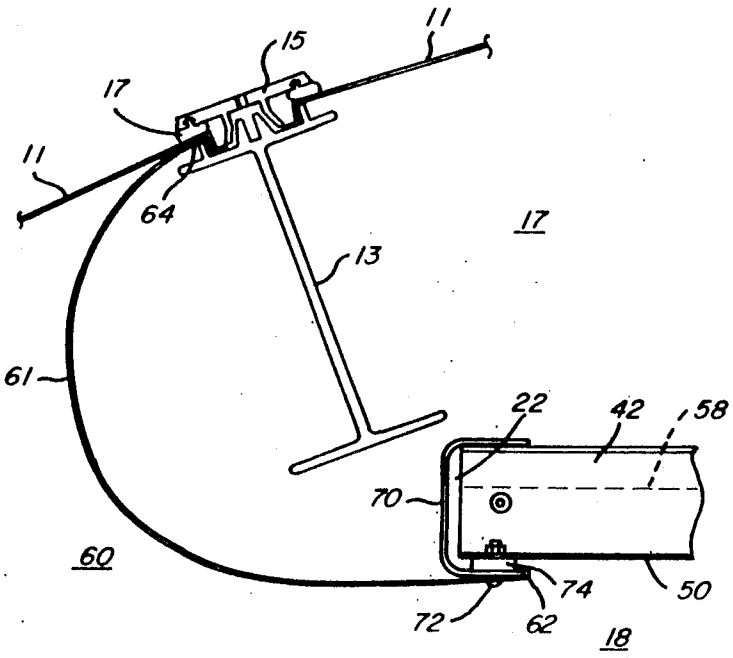
FIG. 7 is an enlarged cross-sectional view taken along line 7—7 of FIG. 1 showing details of the periphery flexible fabric seal.

Referring now to FIG. 7 a detail view of the flexible seal 60 constructed at the periphery or edge 22 of the rigid ceiling 20 is shown. A flexible fabric 61 made of a non-permeable material is connected at one end 62 to the periphery 22 of the rigid ceiling 20 and is connected at the other end 64 to the roof or dome 10.

A U-shaped channel 70 is connected over the periphery 22 of the rigid ceiling 20 preferably using a fastener 72 to hold the connection. A gasket 74 and the flexible fabric 61 are held between the channel 70 and C-beam 42.

The other end 64 of the flexible fabric 61 is preferably sealed to the dome 10 by clamping the flexible fabric 61, a dome panel 11 and gasket 17 between a strut 13 and a batten bar 15. The flexible fabric 61 could be attached to the dome 10 in other manners. For example, connection could be made to the other end of the strut 13 with a gasket and fastener.

Motion may occur with rigid ceiling 20 relative to closure structure 10 during load conditions or conditions of thermal expansion or contraction. Load conditions are created by any combination of the following: The weight of the structure and all material attached to and supported by the structure, the weight of snow or rain upon the structure and any forces created by wind. Through the advent of the flexible fabric 61 motion between the rigid ceiling 20 and the closure structure 10 is accommodated while a seal is maintained between the upper region 17 and the lower region 18.

All gaskets used in the construction of the invention described herein are preferably made of NEOPRENE. NEOPRENE is resistant to ozone and ultraviolet light. The flexible fabric 61 is preferably constructed from a rubberized or synthetic material such as polyurethane on nylon or a tarp sold under the registered trademark "ARMORLON" by Reef Industries, Inc. Urethane/-Nylon style 7576 sold by Reeves Bros., Inc. is resistant to tears, punctures and permeation, is lightweight and can be fabricated to resist heat and ultraviolet degradation. The flexible fabric 61 provides ultraviolet stability while being flexible and airtight. The rigid ceiling 20 as well as the hangers 30 are preferably constructed from a lightweight material to decrease the load on the closure structure 10. A preferable lightweight material is aluminum. All sealants used such as silicone caulk should be resistant to ozone and ultraviolet light as well.

Referring to FIGS. 1 and 7, the channel 70 to be connected over the periphery 22 of the rigid ceiling 20 for attachment of the flexible fabric 61, is preferably cut in short straight pieces joined together around the periphery 22 of the rigid ceiling 20 to form a multi-sided polygon to match the shape of the closure structure 10. The shape of closure structure 10 is determined by the piecing together of triangular panels !1. The periphery 22 of the rigid ceiling 20 which at different junctures may include T-beams 40, C-beams 42 and/or sheeting 50 is also cut to match the polygon shape required. Channel 70 can be adapted to accommodate the structure at each point around the periphery 22 of rigid ceiling 20.

Closure structures 10 such as domes or vaults are designed and built to be watertight so that no water will penetrate and collect on the rigid ceiling 20. The rigid ceiling 20 can be constructed in different sizes, at different elevations and can be adapted to accommodate internal structures such as compression rings or center mechanisms 18 (FIGS. 1 and 2) which must penetrate into the vessel (not shown) or to accommodate walkways 19 to allow workers to enter to inspect and clean the vessel and closure structure 10.

Referring back to FIGS. 1 and 2, a walkway enclosure 19 may be included to allow entry to the closure structure 10. When a walkway enclosure 19 or other interior structure which intersects ceiling 20 is included, an interior edge 24 of the rigid ceiling 20 will be constructed to conform to these interior structures. Such conformity will be made similar to the manner that the periphery 22 of the rigid ceiling 20 is constructed to conform to the shape of the closure structure 10. Flexible fabric 61 can then be attached to an interior edge 24 of the ceiling 20 similar to the attachment shown in FIG. 7. The other end of the flexible fabric 61 is then sealed to the interior structure, such as walkway enclosure 19, by a fastener and/or a gasket. In this manner the rigid ceiling 20 is sealed around interior structures and the rigid ceiling 20 is allowed to move with respect to interior structures.

A sample embodiment of the invention disclosed above included a rigid ceiling approximately eighty-five feet in diameter constructed using 0.05 inch thick aluminum sheeting. The rigid ceiling allowed for two inch radial expansion or contraction of the dome measured at the periphery 22. C-beams 42 and sheeting 50 were approximately seventeen feet, one inch long. Stiffening beams 46 were approximately twenty-three inches long. Silicone caulking was added to the T-beams 40 and sheeting 50 junctures. No caulk was added to the male-female 54, 56 connection of sheeting 50 as a sufficient seal was achieved without such caulking.

The preferred embodiment of the invention has been shown and described above. It is to be understood that minor changes in the details, construction and arrangement of the parts may be made without departing from the spirit or scope of the invention as described and claimed.

We claim:

1. An apparatus to be used in connection with a closure structure above a vessel for reducing the volume of the closure structure into which gases may permeate by separating a stationary lower region from an upper region, comprising:

a plurality of hangers connected at an upper end to the closure structure;

an airtight ceiling connected to a lower end of said hangers for supporting said ceiling within the closure structure; and an airtight edge sealing means including a fixing and sealing means for connecting to an edge of said ceiling and to another structure for sealing off an area located between the edge of said ceiling and the other structure.

2. The apparatus according to claim 1, wherein said ceiling includes:

a plurality of beams connected to said hangers; and a plurality of sheets connected to said beams by a means for attaching.

3. The apparatus according to claim 2, further including a sealant applied to said attaching means.

4. The apparatus according to claim 2, further including a stiffening means attached to said sheets to increase the rigidity of said ceiling.

5. The apparatus according to claim 1, wherein said airtight edge sealing means comprises:

a plurality of channels connected over the edge of said ceiling;

a non-permeable flexible fabric having one end sealingly fixed against said channels;

fixing means for holding said flexible fabric and said channels together; and means for sealingly connecting another end of said flexible fabric to the closure structure.

6. The apparatus according to claim 1, wherein said hangers and said airtight edge sealing means are flexible whereby said ceiling and said airtight edge sealing means maintain an airtight seal under conditions of distortion of the closure structure.

7. The apparatus according to claim 2, wherein said beams, said sheets and said supporting means are constructed from a lightweight material to minimize the load on the closure structure.

8. The apparatus according to claim 7, wherein said lightweight material is aluminum.

9. The apparatus according to claim 1, wherein said edge sealing means further comprises a non-permeable flexible fabric connected at one end to said ceiling and at another end to an internal structure for sealing off an area located between said ceiling and the internal structure.

10. Apparatus for reducing a volume of gases within a closure structure by creating an airtight seal between a lower region and an upper region within the closure structure, comprising:

a plurality of hangers each having an upper end and a lower end where the upper ends are connected to the closure structure;

a ceiling connected to the lower ends of said hangers, said ceiling including:

a plurality of beams connected to the lower ends of said hangers and suspended therefrom; and a plurality of sheets connected to said beams by a means for attaching including a sealant;

a plurality of channels connected over an edge of said ceiling;

a non-permeable flexible fabric having one end sealingly fixed against said channels;

fixing means for holding said non-permeable flexible fabric and said channels together; and means for sealingly connecting another end of said nonpermeable flexible fabric to the closure structure.

11. The apparatus according to claim 10, wherein said beams, said sheets, said hangers and said channels are constructed from a lightweight material to minimize the load on the closure structure.

12. The apparatus according to claim 10, wherein said ceiling further comprises interior sealing means connected at one end to said ceiling and at another end to an internal structure for sealing off an area located between said ceiling and the internal structure.

13. The apparatus according to claim 10, further including a stiffening means attached to said sheeting to increase the rigidity of said ceiling.

14. Apparatus for reducing a volume of gases above a vessel within a closure structure by creating an airtight seal between a lower region and an upper region within the closure structure during normal conditions and during conditions of distortion of the closure structure, comprising:

a plurality of hangers having an upper and a lower end where the upper ends are hinged to the closure structure;

a ceiling hinged to the lower ends of said hangers, said ceiling including:

a plurality of beams hinged to the lower ends of said hangers and suspended therefrom: and a plurality of sheets connected to said beams by a means for airtight sealing and attaching for creating an airtight seal between said sheets and said beams;

a stiffening means attached to said sheeting to increase the rigidity of said ceiling;

a plurality of channels connected over an edge of said ceiling;

a non-permeable flexible fabric having one end sealingly fixed against said channels;

fixing means for holding said non-permeable flexible fabric and said channels together; and means for sealingly connecting another end of said nonpermeable flexible fabric to the closure structure.

15. The apparatus according to claim 14, wherein said beams, said sheets, said hangers and said channels are constructed from a lightweight material to minimize the load on the closure structure.

16. The apparatus according to claim 15, wherein said lightweight material is aluminum.

17. The apparatus according to claim 14, wherein said ceiling further comprises interior sealing means connected at one end to said ceiling and at another end to an internal structure for sealing off an area located between said ceiling and the internal structure.

* * * * *